US005496420A

United States Patent [19]

Kuguminato et al.

[11] Patent Number: 5,496,420

[45] Date of Patent: Mar. 5, 1996

[54] CAN-MAKING STEEL SHEET

[75] Inventors: Hideo Kuguminato; Toshikatsu Kato; Chikako Fujinaga; Kyoko Hamahara, all of Chiba, Japan

[73] Assignee: Kawasaki Steel Corporation, Japan

[21] Appl. No.: 269,488

[22] Filed: Jul. 1, 1994

Related U.S. Application Data

[63] Continuation-in-part of Ser. No. 163,950, Dec. 8, 1993, abandoned, which is a continuation of Ser. No. 43,189, Apr. 6, 1993, Pat. No. 5,360,676.

[30] Foreign Application Priority Data

Apr. 6, 1992 [JP] Japan ..... 4-84210
Apr. 6, 1992 [JP] Japan ..... 4-84212

[51] Int. Cl.[6] ..... C22C 38/26

[52] U.S. Cl. ..... 148/320

[58] Field of Search ..... 148/320

[56] References Cited

U.S. PATENT DOCUMENTS 4,889,566 12/1989 Okada et al. .
5,156,694 10/1992 Yamazaki et al. .

*Primary Examiner*—Deborah Yee
*Attorney, Agent, or Firm*—Austin R. Miller

[57] ABSTRACT

There is provided an ultra-thin and high strength three-piece can-making plated steel sheet which is excellent in weldability and flange forming processibility containing C ≦ about 0.004 wt %, Si≦ about 0.03 wt %, Mn: about 0.05–0.6 wt %, P≦ about 0.02 wt %, S≦ about 0.02 wt %, N≦ about 0.01 wt % Al: about 0.005–0.1 wt %, Nb: about 0.001–0.1 wt % and the balance of inevitable impurities. The steel sheet has a maximum recrystallization grain size of 30 μm or less and a ratio of area of 50% or more which is occupied by recrystallization grains of about 5–25 μm.

3 Claims, 2 Drawing Sheets

CAN-MAKING STEEL SHEET

CROSS-REFERENCE TO RELATED APPLICATIONS

This application is a continuation-in-part of U.S. application Ser. No. 08/163,950 filed Dec. 8, 1993, now abandoned, which is a continuation of U.S. application Ser. No. 08/043,189 filed Apr. 6, 1993, now U.S. Pat. No. 5,360,676.

BACKGROUND OF THE INVENTION

1. Field of the Invention

The present invention relates to a steel sheet used for making three-piece cans and a method of making the steel sheet, and more specifically, to a method of manufacturing a thin and high strength can-making steel sheet excellent in flange formability and weldability.

2. Description of the Related Art

Can-making steel sheets are required to have a thin thickness-and high strength for reducing the cost of making cans. In addition to the above, three-piece can-making steel sheets are further required to be excellent in high speed weldability and flange formability after welding. This occurs because of the following reasons: When three-piece cans are made, can barrels used to form the cans are made by high speed electric welding at a speed up to 70 m/min. Moreover, after the can barrels have been made, a flange forming step is carried out on the can barrels such that each barrel contains a welded portion to mount upper and bottom lids.

However, the prior art has had the problem that when the thickness of a sheet is reduced, the proper welding range is narrowed. Thus, when the welding current is increased, splashing is caused, the weld is hardened and flange cracking tends to occur at the HAZ (heat affected zone) of the weld in a formed flange after formation of a can barrel.

Further, in a recent can-making process, a coil-coated steel strip, which was previously coated at the stage of a coil or a film-laminated steel strip which is made by bonding a printed film to a steel sheet coil, was employed to improve the efficiency of the coating process. In those methods, so-called non-varnished portions to which no coating has been applied or no film has been laminated are preferably formed parallel to the rolling direction when a can is made in order to effectively carry out slitting. However, problems arise in that when the non-varnished portion of a sheet prepared as described above is welded, and then flange forming is carried out, cracking is liable to occur at the HAZ. To cope with this problem, the non-varnished portions are conventionally formed in a direction perpendicular to the rolling direction. Thus, a coil-coated steel strip and a film-laminated steel strip cannot be effectively manufactured.

Many efforts have been made to solve these problems. However, no proposals for directly solving these problems has been found for can-making steel sheets. For example, although Japanese Patent Examined Publication No. 1-52450 discloses a method of manufacturing a can-making steel sheet T1–T3 by continuously annealing ultra-low carbon steel and then temper-rolling the same, it does not disclose a solution to the above problems.

Although U.S. Pat. No. 4,889,566 discloses an ultra-low carbon steel sheet added with Ti, Nb, B to improve spot weldability of automobile-making steel sheets, the patent does not provide any suggestion with respect to problems characteristic to three-piece can-making steel sheets.

Although U.S. Pat. No. 5,156,694 discloses a method of adding Nb, B and further Ti to an ultra-low carbon steel to improve press formability, deep drawability and further fatigue resistant strength at a weld of an automobile-making steel sheet, it mentions nothing with respect to the welding characteristics of can-making steel sheets. Further, the patent mentions nothing with respect to the formability of the HAZ portion of a weld.

OBJECTS OF THE INVENTION

An object of the present invention is to provide a novel three-piece can-making steel sheet and in particular to provide a three-piece can-making steel sheet which is excellent in high speed weldability—it does not cause HAZ cracking of a weld in flange processing (hereinafter, simply referred to as flange cracking or HAZ cracking) carried out after formation of a can barrel.

Another object of the present invention is to provide a can-making steel sheet which enables a can barrel to be wound parallel to the rolling direction and further to which high speed welding can be carried out to thereby provide a steel sheet from which a film-laminated steel strip can be made in which a so-called non-varnished portion is formed in the rolling direction of the steel strip.

A further object of the present invention is to provide a method of manufacturing a thin and high strength can-making steel sheet having the above characteristics.

Other objects of the present invention will be apparent from the claims, detailed description and the like thereof.

SUMMARY OF THE INVENTION

The present invention provides an ultra-thin and high strength Can-making steel sheet which is excellent in weldability and flange formability and contains C≦ about 0.004 wt %, Si≦ about 0.03 wt %, Mn: about 0.05–0.6 wt %, P≦ about 0.02 wt %, S≦ about 0.02 wt %, N≦ about 0.01 wt %, Al: about 0.005–0.1 wt %, Nb: about 0.001–0.1 wt % and a balance of inevitable impurities and has a maximum recrystallization grain size of about 30 μm or less and a ratio of area of about 50% or more which is occupied by recrystallization grains of about 5–25 μm.

DESCRIPTION OF THE PREFERRED EMBODIMENTS

According to studies by the inventors, when a high strength steel is used and non-varnished portions are formed in the L direction, HAZ cracking often occurs during flange forming under the following conditions. First, HAZ cracking is liable to occur when a large stress concentration is produced by restriction of the nugget portion of the weld. More specifically, when the nugget portion of the weld has a large peak hardness, a stress concentration occurs due to the restriction of that portion and cracking occurs at the HAZ portion in the vicinity of the nugget portion in combination with a small elongation of the steel sheet in the C direction and the weakness of the grain boundary to be shown later. When a sheet is rolled into a thin thickness, this phenomenon is made more remarkable because its elongation is made small.

Further, when the grain size of the sheet is larger than a certain value, HAZ cracking occurs. More specifically, when the grain size is large, the boundary of a pancake-shaped grain is weakened and the HAZ portion is liable to be broken by a tensile strength applied in a direction perpendicular to the longitudinal direction of the grain boundary when the flange forming step is carried out.

Figure 3:
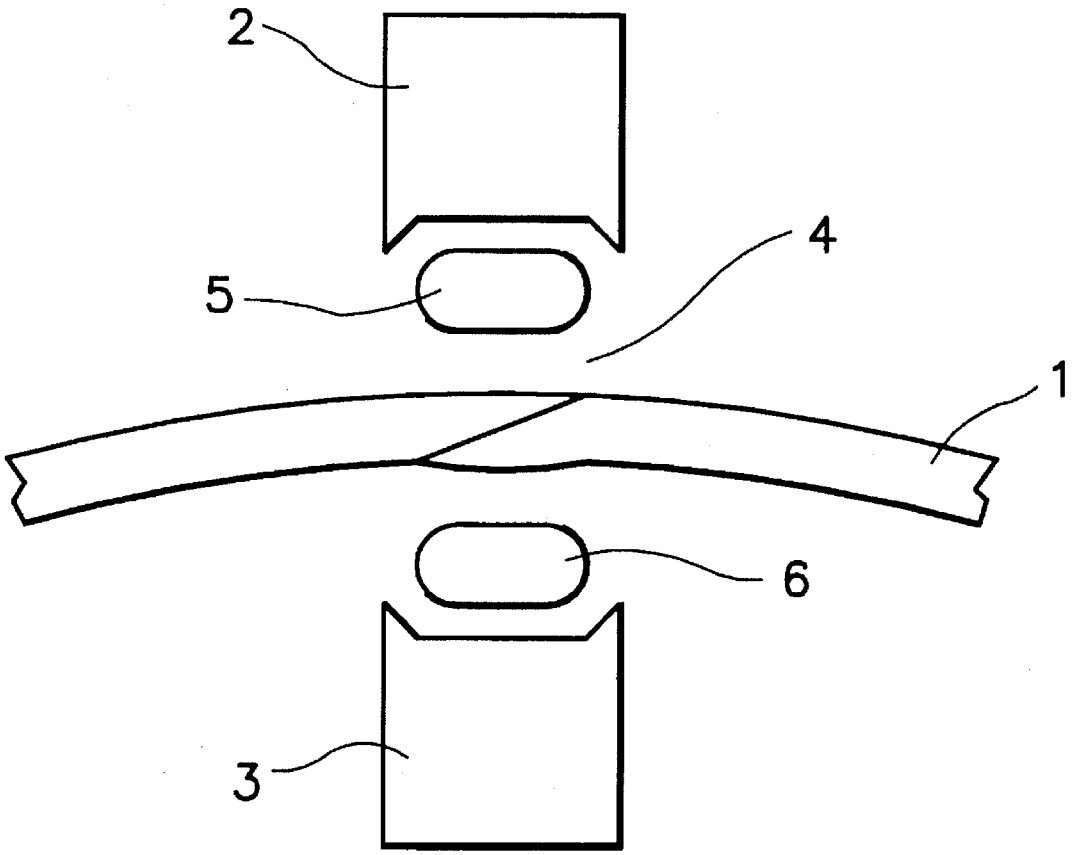
FIG. 3 is a schematic view of a weld when a can-making steel sheet is formed into a can.

FIG. 3 is a schematic view of a weld when a can-making steel sheet is formed into a can. In FIG. 3, a sheet to be formed 1 is overlapped at the opposite ends thereof and the overlapped portion is welded by applying a current while the overlapped portion is pressed by electrode rings 2, 3 through an external copper wire 5 and an internal copper wire 6 to thereby form a nugget portion 4. Although the weld of a can barrel is formed while being overlapped, the pressure of the overlapped portion is not reduced by the press carried out by electrode rings 2, 3 when the overlapped portion is welded and a stress concentration is caused by the restriction of the overlapped portion when the sheet to be processed 1 has a thickness larger than a certain value. Thus, cracking occurs in the aforesaid weak grain boundary.

The inventors have succeeded providing a novel three-piece can-making steel sheet by making clear the material conditions of a sheet to be processed with respect to HAZ cracking which occurs when flange forming is carried out.

(1) Chemical Composition

C generally hardens a material and in particular rapidly increases the hardness of the HAZ portion. It also affects flange forming characteristics through the hardness of the HAZ portion of the weld of a can-making steel sheet and the thickness of the weld. Therefore, C is limited to a content of about 0.004% or less.

A conventional can-making steel sheet has a C content of 0.03–0.06%. In this case, when a sheet has a thickness of about 0.2–0.25 mm, non-varnished portions are formed perpendicular to the rolling direction and welding is carried out along the non-varnished portions, no HAZ cracking occurs. When the non-varnished portions are formed parallel to the rolling direction and welding is carried out along the non-varnished portions, flange cracking occurs when a can is expanded.

This phenomenon is believed to be caused by an increase in the hardness of the weld and stress concentration due to an increase in the thickness of the weld caused by the increase in hardness. These phenomena can be solved by reducing the C content to a very low level, specifically to a level of about 0.004% or less. For example, when C is contained in an amount of about 0.004% or less, the weld nugget portion has a low hardness even if it is rapidly cooled when welded because the grain size is not made small, the stress concentration is eased at the HAZ portion and it is therefore difficult to cause HAZ cracking (compare Example 1 of the invention with Comparative Example 3 in Table 1).

An ultra-low carbon cold-rolled steel sheet has a large grain size and is in a softened state when it has been subjected to a CAL (continuous annealing). When the steel sheet is used as a can-making steel sheet, however, it is subjected to temper-rolling after having been annealed so that its strength is increased by work-hardening. Thus, the stress concentration is eased because the steel sheet is easily softened by heat applied during welding and greatly elongated. This also occurs because the thickness of the portion overlapped for welding of the nugget portion is made thin by pressure applied during welding with the result that the steel sheet is softened during welding and no restriction is caused by the thickness of the sheet.

When C is contained in an amount of about 0.004% or less, however, the grain size of a steel sheet is generally increased. Thus, when a can is expanded, flange cracking occurs at the welded HAZ portion, to which a separate countermeasure must be applied.

Si not only deteriorates the corrosion resistance of can-making steel sheets but also extremely hardens the material and, as a result, adversely affects flange forming characteristics. Thus, Si must be contained in an amount of about 0.03% or less.

When Mn is contained in an amount of about 0.6% or more, the grain size is excessively refined, the material is hardened and the total thickness of the nugget portion is made too thick, thereby deteriorating flange forming characteristics. On the other hand, although Mn has no lower content limit from the view point of flange forming characteristics, it must be added in an amount of about 0.05% or more to prevent-edge cracking of a hot-rolled coil caused when the steel sheet is in the rolling process.

Since P hardens a material and deteriorates the corrosion resistance of can-making steel sheets, it must be contained in an amount of about 0.02% or less.

Although S does not directly affect flange forming characteristics, it is limited to a content of about 0.02% or less to prevent edge cracking of the hot-rolled steel sheet in the steel sheet manufacturing process. It should be noted that S is preferably contained in such an amount as to set a Mn/S ratio to about 8 or more in the relationship thereof with the aforesaid Mn to prevent edge cracking.

Al is generally added as a deoxidation agent in the steel manufacturing process to increase the cleanliness of the steel. Further, since Al fixes N in the steel sheet, it is added in an amount of about 0.005% or more. Since excess addition of Al restricts the growth of crystal grains and an adverse effect appears in flange forming characteristics, however, it is limited to an amount of about 0.10% or less.

Since an excess amount of N hardens steel to thereby deteriorate flange forming characteristics, it is limited to an amount of about 0.01% or less.

Since O forms an oxide together with Al and Mn in steel and deteriorates the corrosion resistance of a can and flange forming characteristics, it must be limited to an amount of about 0.01% or less.

Nb is an important element which affects recrystallized grains having been annealed and flange forming characteristics through the recrystallized grains. More specifically, although ultra-low carbon steel is employed as the steel of the present invention from the view point of hardness, thickness and the like of a weld as described above, Nb must be added to the ultra-low carbon steel to prevent coarsening of crystal grains which are characteristic of the ultra-low carbon steel to thereby prevent HAZ cracking. Nb is preferably added in an amount by which the grain size to be indicated later can be obtained, and specifically it is preferably added in an amount of about 0.003–0.02%.

Although Sn, Sb, As and Te are not particularly related to the can expanding properties which are the subject matter of the present invention, Sn and/or Sb may be added in an amount of about 0.001% or less, As may be added in an amount of about 0.001% or less and Te may be added in an amount of about 0.0001% or less from a view point of corrosion resistance.

Ca may be added in an amount of about 0.005% or less for the shape of inclusions such as $Al_2O_3$, etc.

(2) Grain Size

An excessively large or excessively small grain size causes flange cracking at the HAZ portion in the can expanding process to be carried out after the can barrel has been welded.

Figure 1:
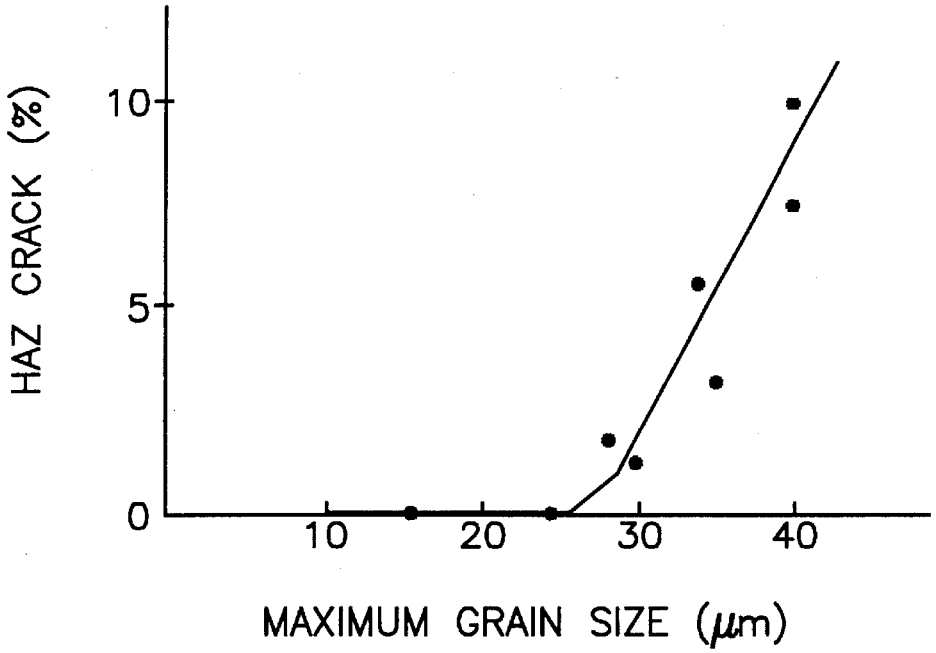
FIG. 1 is a graph showing the relationship between the ratio of occurrences of HAZ cracking and maximum grain size.

FIG. 1 shows the relationship between the maximum grain size of the can-making steel sheet and flange cracking when the can barrel is wound parallel to the rolling direction of the steel sheet in place of a conventional direction perpendicular to the rolling direction of the steel sheet. It can be found from FIG. 1 that when the can barrel is wound in the direction parallel to the rolling direction of the steel sheet, a lot of HAZ cracking typically occurs unless the maximum crystallized grain size is about 30 μm or preferably about 25 μm or less. Although the reason for this phenomenon is not completely clear, it is believed to be caused by the weakness of the grain boundary due to the segregation of impure elements at the grain boundary.

Figure 2:
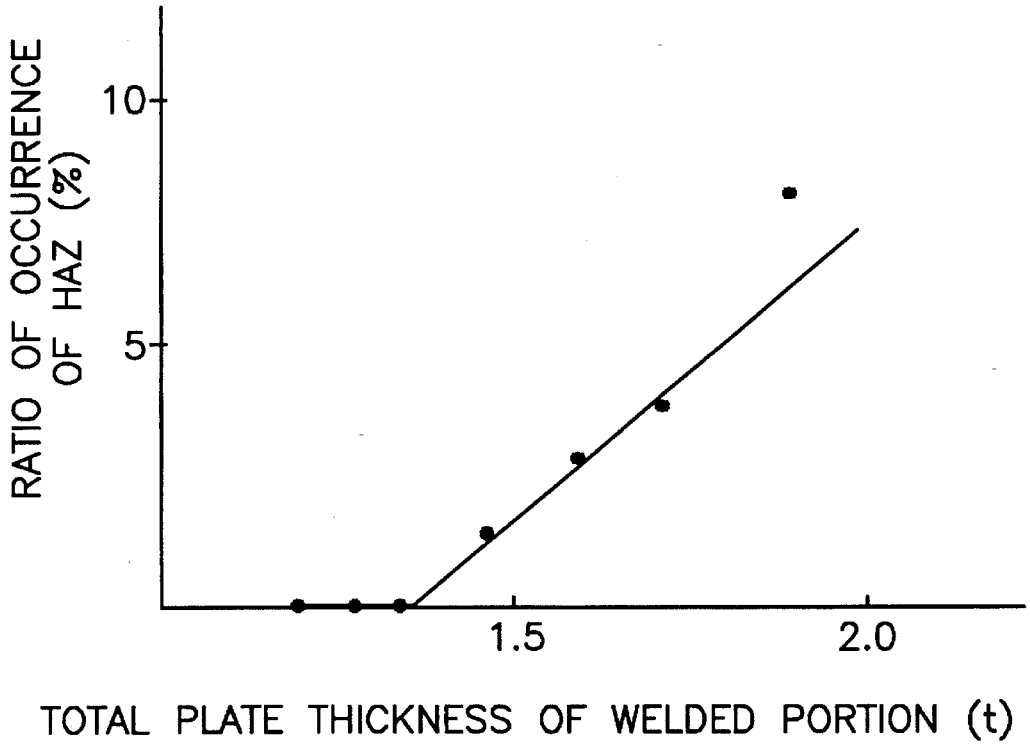
FIG. 2 is a graph showing the relationship between total thickness of a weld and the ratio of occurrences of HAZ cracking.

FIG. 2 shows the relationship between the degree of reduction of weld thickness and the ratio of occurrence of HAZ cracking when the can barrel of a three-piece can is joined by high speed welding. As shown in FIG. 2, when the total thickness of the weld is 1.4 times or more the thickness of the sheet (hereinafter the thickness of the sheet is freely abbreviated to "t") to be processed, stress produced in the flange forming step is liable to concentrate. Thus, a good quantity of HAZ cracking is liable to occur.

The grain size of the sheet to be processed affects the total thickness of the weld. According to experiments carried out by the inventors, it was found that when the ratio of area occupied by crystal grains of 5–25 μm is about 50% or more, the total thickness of the weld is about 1.4 times or less the thickness of the sheet to be processed when the usual high speed welding is carried out. It should be noted that since the degree of winding and tightening processing of 7% or more is required for cans such as beverage cans having a small can diameter, the minimum crystal grain size must be about 10 μm or less in this case.

To summarize the aforesaid points, a sheet to be plated is required to have the conditions that all the crystal grains exist in the range of crystal grains of about 30 μm or less and the ratio of area occupied by crystal grains of about 5–25 μm is about 50% or more. In making this calculation, grain size is measured by a method of calculating average values of the sizes in a longer diameter direction and shorter diameter direction of the crystal grains in a sheet to be plated.

(3) Rolling Conditions

A steel sheet having the aforesaid distribution of grain sizes has excellent properties for a three-piece can-making steel sheet and a steel sheet having such a distribution of grain sizes and can be manufactured by rolling a steel sheet satisfying the above amounts of C and Nb under the following conditions.

(i) Finish Temperature in Hot-Rolling (FDT):

When the finishing temperature is too high or too low, grain sizes after recrystallization are unnecessarily coarsened. Thus, the temperature is set to 800°–900° C.

(ii) Coiling Temperature (CT)

When the coiling temperature is too high, crystal grains are grown and coarsened by self-annealing, whereas when the temperature is too low, not only are crystal grains not sufficiently grown and made too small but also a rolled grain structure may remain even in an ultra-low carbon steel. Thus, the CT is set to 500°–650° C.

(iii) Rolling Reduction in Cold-Rolling

The rolling reduction in cold-rolling is quite important as a factor for controlling a grain size. When the rolling reduction is too low, crystal sizes are coarsened in an annealing process to be carried out thereafter and the uniformity of the grain sizes is also lowered. Thus, the rolling reduction must be set to 85% or more. A hot-rolled steel strip is preferably a little thicker to make the temperature distribution thereof uniform and the grain size resulting therefrom uniform. Thus, the rolling reduction is preferably set to 90% or more to obtain a cold-rolled steel sheet with a predetermined thickness from such a slightly thicker hot-rolled steel strip.

(iv) Continuous Annealing Conditions

The continuous annealing conditions are set according to a usual method such that the temperature is 720° C. or more, which is the recrystallization temperature. The annealing time is within 60 seconds at 800° C. which is a temperature at which grain sizes are not coarsened. These conditions are set to obtain a steel sheet having a suitable thickness.

EXAMPLES

Steels having compositions shown in Table 1 were melted in an amount of 270 tons in a bottom-blowing converter and subjected to an R - H vacuum degassing processing to obtain melted steels containing C decarbonized to 0.004% or less, and slabs having required compositions shown in Table 1 were manufactured by a continuously casting machine. These slabs each having a size of 260 mm were rolled to hot-rolled sheets of 2.3 mm thickness under conditions shown in Table 1 and rolled to sheets of 0.22 mm thick by a six-stand tandem cold-rolling mill after descaling. The rolling reduction in cold-rolling was 90.4%.

After being subjected to the cold-rolling process, the cold-rolled sheets were subjected to continuous annealing and further to temper-rolling so that they were rolled to ultra-thin steel sheets of 0.130 mm thick. The rolling reduction in temper-rolling was 41% and sheets to be processed to make can-making steel sheets which were adjusted to have a tempered hardness of DR8 by work-hardening were obtained. Sn(tin) was plated on each side of the sheets to be processed in an amount of 2.8 g/m$^2$ to finish the sheets to beverage-can-making coils. Characteristic values of can-making steel sheets in accordance with manufacturing conditions are as shown in Table 1 (No. 2).

Each of the coils was laminated with a film except so-called non-varnished portions. The non-varnished portions were formed parallel to the rolling direction of the coil. Blank sheets for each can unit were obtained from the film-laminated coil and beverage can barrels were made by high speed welding at 70 m/min.

After being subjected to a three-stage neck-in processing, each beverage can barrel was subjected to a flange forming process and the characteristic values thereof were tested. Test items were an actual measurement of the total thickness of the weld, a measurement of the maximum hardness of the nugget portion by measurement of the micro Vickers hardness thereof, and the presence or absence of HAZ cracking. HAZ cracking was determined to occur when cans subjected to the above flange forming process were crushed so that the welds thereof were flattened and even a single can of 100 cans was cracked.

The following results from Table 1 were found.

In the case of Example 1 of the invention, since crystal grains had a proper size and the C content was ultra-low, the hardness of the welded nugget portion increased and the total thickness of the weld increased to 1.3 t and thus no HAZ cracking occurred.

On the other hand, Comparative Examples 2 and 3 contained a large amount of C and had a small grain size as a whole as well as a large total thickness of 1.5 t to 1.6 t and HAZ cracking occurred. Comparative Example 4 contained a large amount of Nb and had a large amount of crystal grains having a grain size of 5–25 μm due to the large amount of Nb. Thus, the total thickness of the weld was thickened and HAZ cracking occurred. Although Comparative Example 5 having coarsened crystal grains due to an increase in FDT was soft and had a thin total thickness of the weld of 1.4 t, HAZ cracking occurred in the coarse grain boundary. A similar result was observed in Comparative Example 6 whose grain sizes were increased by increasing CT. A similar result was obtained in Comparative Example 7 whose grain sizes were coarsened by increasing the annealing temperature in continuous annealing conditions.

TABLE 1

(No. 1 CHEMICAL COMPOSITION WT %)

| Example | C | Si | Mn | P | S | N | Al | Nb |
|---|---|---|---|---|---|---|---|---|
| Example 1 | 0.002 | 0.03 | 0.20 | 0.015 | 0.011 | 0.0031 | 0.015 | 0.0026 |
| Comparative Example 2 | 0.006 | 0.03 | 0.38 | 0.014 | 0.018 | 0.0042 | 0.091 | 0.0031 |
| Comparative Example 3 | 0.008 | 0.01 | 0.10 | 0.013 | 0.010 | 0.0021 | 0.152 | 0.0038 |
| Comparative Example 4 | 0.003 | 0.03 | 0.51 | 0.015 | 0.011 | 0.0082 | 0.078 | 0.1266 |
| Comparative Example 5 | 0.003 | 0.03 | 0.45 | 0.015 | 0.011 | 0.0064 | 0.078 | 0.0022 |
| Comparative Example 6 | 0.003 | 0.03 | 0.15 | 0.005 | 0.008 | 0.0015 | 0.083 | 0.0017 |
| Comparative Example 7 | 0.003 | 0.15 | 0.005 | 0.008 | 0.008 | 0.0015 | 0.083 | 0.0013 |

(No. 2 MANUFACTURING CONDITIONS, CHARACTERISTIC VALUES)

| Example | Hot-Rolling conditions FDT °C. | Hot-Rolling conditions CT C°. | Continuous Annealing Temperature °C. | Maximum Grain Size μm | Ratio Occupied by 5–25 μm % | Total Thickness of Weld mm (Ratio to Sheet to be Processed) | Maximum Hardness of Nugget Portion HV | Occurrence of HAZ Cracking |
|---|---|---|---|---|---|---|---|---|
| Example 1 | 840 | 600 | 800 | 26 | 85 | 0.169 (1.3 t) | 210 | Not occurred |
| Comparative Example 2 | 840 | 610 | 750 | 20 | 46 | 0.195 (1.5 t) | 210 | Occurred |
| Comparative Example 3 | 850 | 630 | 750 | 18 | 39 | 0.208 (1.5 t) | 222 | Occurred |
| Comparative Example 4 | 850 | 650 | 750 | 19 | 42 | 0.195 (1.5 t) | 168 | Occurred |
| Comparative Example 5 | 910 | 650 | 750 | 38 | 82 | 0.182 (1.4 t) | 171 | Occurred |
| Comparative Example 6 | 850 | 700 | 750 | 40 | 90 | 0.169 (1.3 t) | 173 | Occurred |
| Comparative Example 7 | 850 | 570 | 820 | 35 | 73 | 0.182 (1.4 t) | 173 | Occurred |

What is claimed is:

1. An ultra-thin and high strength can-making steel sheet excellent in weldability and flange forming processibility comprising C≦ about 0.004 wt %, Si≦ about 0.03 wt %, Mn: about 0.05–0.6 wt %, P≦ about 0.02 wt %, S≦ about 0.02 wt %, N≦ about 0.01 wt %, Al: about 0.005–0.1 wt %, and Nb: about 0.001–0.1 wt % and the balance Fe, said sheet having a maximum recrystallization grain size of about 30 μm or less, and said sheet having a ratio of area which is occupied by recrystallization grains having crystallized grain sizes of about 5–25 μm, of at least about 50%.

2. The steel sheet defined in claim 1 wherein the amount of Mn and S have a Mn/S ratio of about 8 or more.

3. The steel sheet defined in claim 1 wherein said maximum recrystallization grain size is about 25 μm or less.

* * * * *